US008526837B2

(12) United States Patent
Kusumoto

(10) Patent No.: US 8,526,837 B2
(45) Date of Patent: Sep. 3, 2013

(54) IMAGE FORMING APPARATUS WITH CASSETTE DETECTION AND ENERGY SAVING MODE SHIFTING CONTROL

(75) Inventor: Koji Kusumoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 328 days.

(21) Appl. No.: 12/878,193

(22) Filed: Sep. 9, 2010

(65) Prior Publication Data

US 2011/0064504 A1 Mar. 17, 2011

(30) Foreign Application Priority Data

Sep. 11, 2009 (JP) ..... 2009-210577

(51) Int. Cl.
*G03G 21/00* (2006.01)
*B41J 29/38* (2006.01)
*B65H 3/44* (2006.01)

(52) U.S. Cl.
USPC ..... 399/70; 399/88; 399/391; 399/393; 400/76

(58) Field of Classification Search
USPC ..... 399/70, 88, 89, 393, 391
See application file for complete search history.

(56) References Cited

U.S. PATENT DOCUMENTS

| | | | | |
|---|---|---|---|---|
| 4,745,436 | A * | 5/1988 | Matsuura | 399/70 |
| 2005/0158067 | A1* | 7/2005 | Kim et al. | 399/70 |
| 2005/0211692 | A1* | 9/2005 | Maitani | 219/216 |
| 2006/0007468 | A1* | 1/2006 | Tanaka | 358/1.14 |

FOREIGN PATENT DOCUMENTS

| | | | |
|---|---|---|---|
| JP | 2002-172832 | | 6/2002 |
| JP | 2003012166 | A * | 1/2003 |
| JP | 2003-291460 | | 10/2003 |
| JP | 2006326861 | A * | 12/2006 |
| JP | 2008216829 | A * | 9/2008 |

* cited by examiner

*Primary Examiner* — Daniel J Colilla
(74) *Attorney, Agent, or Firm* — Smith, Gambrell & Russell, LLP

(57) ABSTRACT

An image forming apparatus having a first mode for operation with predetermined power consumption and a second mode for operation with less power consumption than the power consumption in the first mode includes: a paper cassette capable of being attached to a predetermined section of the image forming apparatus, the paper cassette storing paper therein; a detection part detecting the attachment and detachment of the paper cassette to and from the predetermined section; and a shift part, upon the detection by the detection part that the paper cassette has been attached to the predetermined section during the operation in the second mode, shifting the image forming apparatus from the second mode to the first mode.

5 Claims, 4 Drawing Sheets

IMAGE FORMING APPARATUS WITH CASSETTE DETECTION AND ENERGY SAVING MODE SHIFTING CONTROL

This application is based on Japanese Patent Application No. 2009-210577 filed on Sep. 11, 2009, the contents of which are hereby incorporated by reference.

BACKGROUND OF THE INVENTION

1. Field of the Invention

The present invention relates to an image forming apparatus and more specifically to an image forming apparatus loaded with a sleep mode.

2. Description of Related Art

In an image forming apparatus, a paper feed part is provided which supplies paper to an image forming part where an image is formed. The paper feed part includes a paper cassette that stores paper. The paper cassette is detached from the image forming apparatus upon paper storage. Then after the paper storage into the paper cassette, it is attached to the image forming apparatus.

Moreover, in terms of power consumption saving, a normal mode and a sleep mode are typically loaded in the image forming apparatus. The normal mode corresponds to a state in which a temperature of a fixing roller is kept at a temperature appropriate for fixing developer such as a toner and thus image formation can be performed immediately upon acceptance of an image formation request. Thus, the normal mode is a mode with high power consumption. On the other hand, the sleep mode corresponds to a state in which temperature of the fixing roller is higher than a room temperature but kept lower than that in the normal mode and thus the image formation cannot be performed immediately upon the acceptance of the image formation request, thus requiring some time from when the fixing roller heats up to when it reaches an appropriate temperature. Therefore, the sleep mode is a mode with lower power consumption than that in the normal mode.

The image forming apparatus shifts to the sleep mode after staying in standby for predetermined time without accepting the image formation request during operation in the normal mode. Moreover, the image forming apparatus deactivates the sleep mode upon acceptance of the image formation request during operation in the sleep mode. That is, it shifts to the normal mode.

As described above, the image forming apparatus loaded with the sleep mode is disclosed in, for example, JP-A-2002-172832 and JP-A-2003-291460.

According to JP-A-2002-172832, the image forming apparatus deactivates a sleep mode upon detachment of a paper cassette during operation in the sleep mode. Then after calculation of the number of pieces of paper inside the paper cassette, the image forming apparatus shifts again to the sleep mode.

Also in JP-A-2003-291460, the image forming apparatus deactivates a sleep mode upon detachment of a paper cassette during operation in the sleep mode.

With the technologies disclosed in JP-A-2002-172832 and JP-A-2003-291460, at a stage at which the paper cassette is detached, the sleep mode is deactivated and shift to the normal mode occurs. In that case, for example, even when the paper cassette is left in a continuously detached state for predetermined time, there is a risk of wasteful power consumption.

SUMMARY OF THE INVENTION

The present invention has been made in view of the problem described above, and it is an object of the invention to provide an image forming apparatus capable of efficiently saving power consumption.

To achieve the object described above, an image forming apparatus according to one aspect of the invention having a first mode for operation with predetermined power consumption and a second mode for operation with less power consumption than the power consumption in the first mode, the image forming apparatus includes: a paper cassette capable of being attached to a predetermined section of the image forming apparatus, the paper cassette storing paper therein; a detection part detecting the attachment and detachment of the paper cassette to and from the predetermined section; and a shift part, upon the detection by the detection part that the paper cassette has been attached to the predetermined section during the operation in the second mode, shifting the image forming apparatus from the second mode to the first mode.

With such configuration, the image forming apparatus, upon the detection that the paper cassette has been attached during the operation in the second mode, shifts from the second mode to the first mode. Consequently, for example, even in a case where the paper cassette is left in a continuously detached state for predetermined time, until the detection that the paper cassette has been attached, the second mode is maintained, thus not resulting in wasteful power consumption. This consequently makes it possible to efficiently save the power consumption.

In the above configuration, the shift part, upon the detection by the detection part that the paper cassette has been attached to the predetermined section after detached from the predetermined section during the operation in the second mode, may shift the image forming apparatus from the second mode to the first mode.

In the above configuration, as the paper cassette, a plurality of paper cassettes may be provided, and the shift part may maintain the second mode until detection by the detection part that all the plurality of paper cassettes has been attached to the predetermined section.

In the above configuration, the paper cassette may be movable by being attached to and detached from the predetermined section, the detection part may have: a predetermined circuit turned ON/OFF for current flow control and a circuit component member movable in conjunction with the paper cassette, the circuit component member may move to a position forming part of the predetermined circuit upon the attachment of the paper cassette to the predetermined section, and may move to a position away from the predetermined circuit upon the detachment of the paper cassette from the predetermined section, and the detection part, as a result of the turning ON of the current flowing through the predetermined circuit, may detect that the paper cassette has been attached to the predetermined section.

In the above configuration, as the paper cassette, a plurality of paper cassettes may be provided, and as the circuit component member, a plurality of circuit component members may be respectively provided in correspondence with the plurality of paper cassettes.

In the above configuration, the plurality of circuit component members may form part of the same predetermined circuit upon the attachment of the paper cassette to the predetermined section.

In the above configuration, through the predetermined circuit, the current may flow as a result of attaching all the plurality of paper cassettes to the predetermined section, and the flowing current may be shut off upon detachment of at least one of the plurality of paper cassettes from the predetermined section.

DETAILED DESCRIPTION OF PREFERRED EMBODIMENTS

Figure 1:
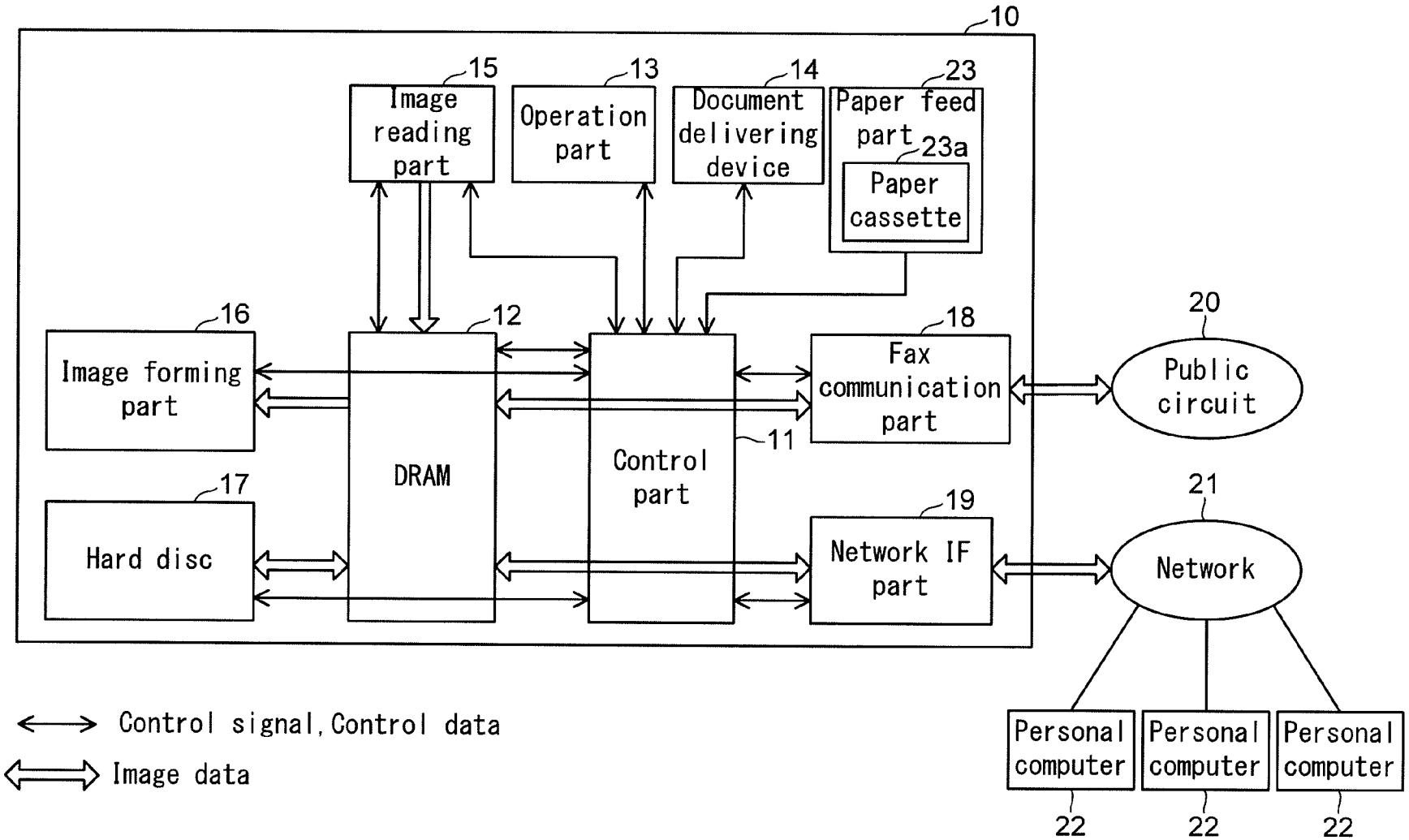
FIG. 1 is a block diagram showing configuration of a digital multifunction printer in a case where an image forming apparatus according to one embodiment of the present invention is applied to the digital multifunction printer.

Hereinafter, referring to the accompanying drawings, an image forming apparatus according to one embodiment of the present invention will be described. FIG. 1 is a block diagram showing configuration of a digital multifunction printer 10 in a case where the image forming apparatus according to the embodiment of the invention is applied to the digital multifunction printer 10. Referring to FIG. 1, the digital multifunction printer 10 is provided with: a control part 11 that controls the entire digital multifunction printer 10; a DRAM 12 for performing writing and reading of image data, etc.; an operation part 13 that serves as an interface with a user in the digital multifunction printer 10; a document delivering device 14 that automatically conveys a document to a predetermined document read position; an image reading part 15 that reads, through scanning at the predetermined read position, an image of the document conveyed by the document delivering device 14; an image forming part 16 that includes a fixing roller, etc. fixing the image onto paper through heating and that forms the image on the paper based on the document or the like read by the image reading part 15; a hard disc 17 that stores image data, etc.; a fax communication part 18 connected to a public line 20; a network IF (interface) part 19 for connection with a network 21; and a paper feed part 23 that includes a paper cassette 23*a* storing paper and that supplies the paper to the image forming part 16.

The digital multifunction printer 10 operates as a copier by forming an image in the image forming part 16 via the DRAM 12 by use of the document read by the image reading part 15. Moreover, the digital multifunction printer 10 operates as a printer by forming an image in the image forming part 16 via the DRAM 12 by use of image data transmitted from a personal computer 22 connected to the network 21. Furthermore, the digital multifunction printer 10 operates as a fax machine by forming an image in the image forming part 16 via the DRAM 12 by use of image data transmitted from the public line 20 via the fax communication part 18 and also by transmitting to the public line 20 via the fax communication part 18 the image data of the document read by the image reading part 15. That is, the digital multifunction printer 10 has a plurality of functions for image processing, including a copy function, a printer function, and a fax function. Further, for each of the functions, a function for which detailed setting can be made is provided.

The digital multifunction printer 10 has: a normal mode as a first mode in which it operates with predetermined power consumption; and a sleep mode as a second mode in which it operates with power consumption less than the predetermined power consumption.

The normal mode corresponds to a state in which a temperature of the fixing roller is kept at a temperature appropriate for fixing developer such as a toner and thus image formation can be performed immediately upon acceptance of an image formation request. Therefore, the normal mode is a mode with high power consumption.

On the other hand, the sleep mode corresponds to a state in which the temperature of the fixing roller is kept at a temperature higher than a room temperature but lower than that in the normal mode and thus the image formation cannot be performed immediately upon the acceptance of the image formation request, thus requiring some time from when the fixing roller heats up to when it reaches the appropriate temperature. Therefore, the sleep mode is a mode with lower power consumption than that in the normal mode.

The digital multifunction printer 10 shifts to the sleep mode after staying in standby for predetermined time without accepting the image formation request during operation in the normal mode. Moreover, the digital multifunction printer 10 deactivates the sleep mode, for example, upon the acceptance of the image formation request during operation in the sleep mode. That is, the digital multifunction printer 10 shifts to the normal mode.

In FIG. 1, an arrow of a bold line shows a flow of image data and an arrow of a thin line shows a flow of a control signal or control data.

Figure 2:
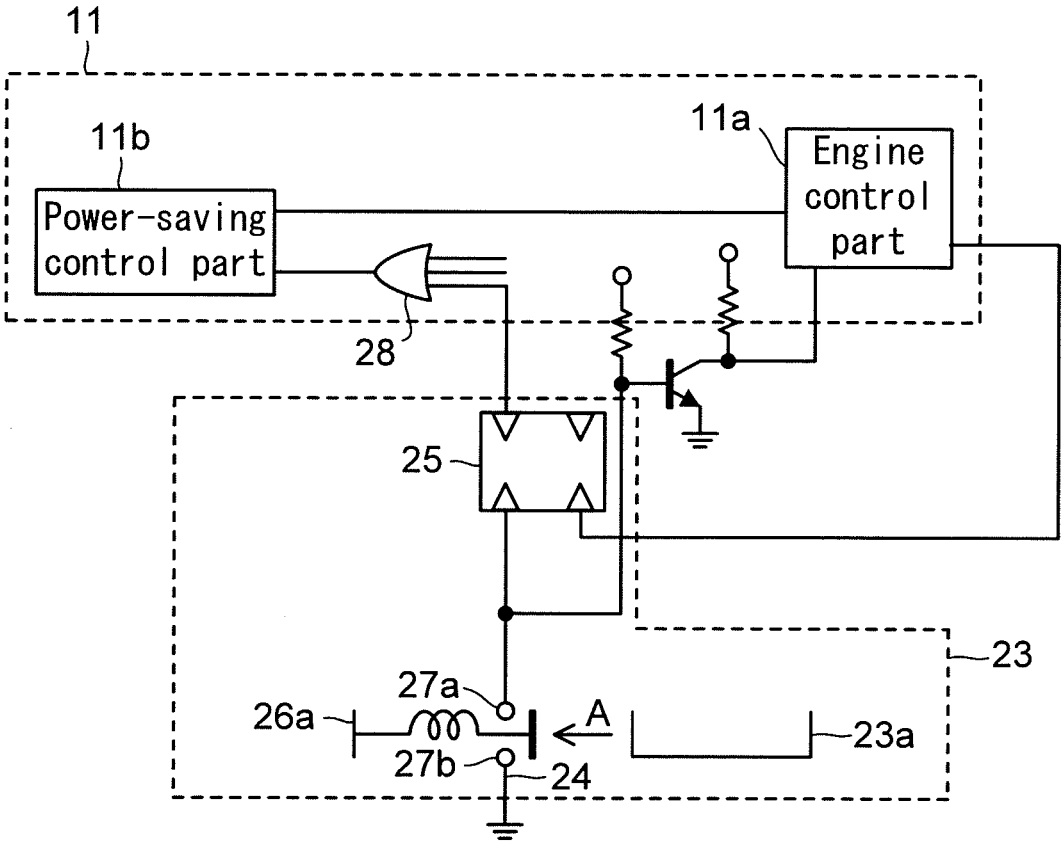
FIG. 2 is a diagram showing details of a control part and a paper feed part.

FIG. 2 is a diagram showing details of the control part 11 and the paper feed part 23. Referring to FIG. 2, the control part 11 is provided with an energy-saving control part 11*b* and an engine control part 11*a*.

The energy-saving control part 11*b*, when supplied with a current in the sleep mode, accepts predetermined requests on the digital multifunction printer 10 in the sleep mode. Moreover, the energy-saving control part 11*b*, by use of, for example, an OR circuit 28, accepts, of the requests on the digital multifunction printer 10 in the sleep mode, a collection of the requests requiring control by the engine control part 11*a*. This can make processing in the energy-saving control part 11*b* easier. The request requiring the control by the engine control part 11*a* is a request, for example, an image formation request or the like that requires a shift from the sleep mode to the normal mode. Moreover, the energy-saving control part 11*b*, upon the acceptance of the request requiring the control by the engine control part 11*a*, which is included in the predetermined requests on the digital multifunction printer 10 in the sleep mode, performs control in a manner such that a current is supplied to the engine control part 11*a*.

The engine control part 11*a* performs control of the image forming part 16, including temperature control of the fixing roller, etc., and is supplied with a current in the sleep mode only when necessary.

The paper feed part 23 is provided with the paper cassette 23*a*. The paper cassette 23*a* can be attached to a predetermined section of the digital multifunction printer 10. The paper cassette 23*a* is detached from the digital multifunction printer 10 by the user upon paper storage. Then after the paper storage into the paper cassette 23*a*, the paper cassette 23*a* is attached to the digital multifunction printer 10. That is, the paper cassette 23*a* can be moved by attachment to the predetermined section of the digital multifunction printer 10 and detachment from this predetermined section.

Here, an attachment state of the paper cassette 23*a* is outputted from a flip-flop circuit 25 to the energy-saving control part 11*b*. Specifically, the paper feed part 23 includes the flip-flop circuit 25, and has: a predetermined circuit 24 that is turned ON/OFF for current flow control; and a circuit component member 26*a* that is movable in conjunction with the paper cassette 23*a*. The flip-flop circuit 25 outputs a High or Low signal to the OR circuit 28 in accordance with a position of the circuit component member 26*a* to thereby output the attachment state of the paper cassette 23*a* to the energy-saving control part 11*b*.

More specifically, the circuit component member 26*a* is, for example, a switch, and connects together one terminal 27*a* and another terminal 27*b* upon attachment of the paper cassette 23*a* to the digital multifunction printer 10 as a result of movement in a direction of an arrow A in FIG. 2. That is, the circuit component member 26*a*, upon the attachment of the paper cassette 23*a* to the digital multifunction printer 10, moves to a position forming part of the predetermined circuit 24 to form part of the predetermined circuit 24. At this point, the flip-flop circuit 25, as a result of turning ON of the current flowing through the predetermined circuit 24, outputs to the energy-saving control part 11*b* the Low signal indicating that the paper cassette 23*a* has been attached. Then upon detachment of the paper cassette 23*a* from the digital multifunction printer 10 as a result of movement in a direction opposite to the direction of the arrow A in FIG. 2, one terminal 27*a* and another terminal 27*b* are disconnected. That is, the circuit component member 26*a*, upon the detachment of the paper cassette 23*a* from the digital multifunction printer 10, moves to a position away from the predetermined circuit 24, and thus no longer forms the predetermined circuit 24. At this point, the flip-flop circuit 25, as a result of turning OFF of the current flowing through the predetermined circuit 24, outputs to the energy-saving control part 11*b* the High signal indicating that the paper cassette 23*a* has been detached.

Figure 3:
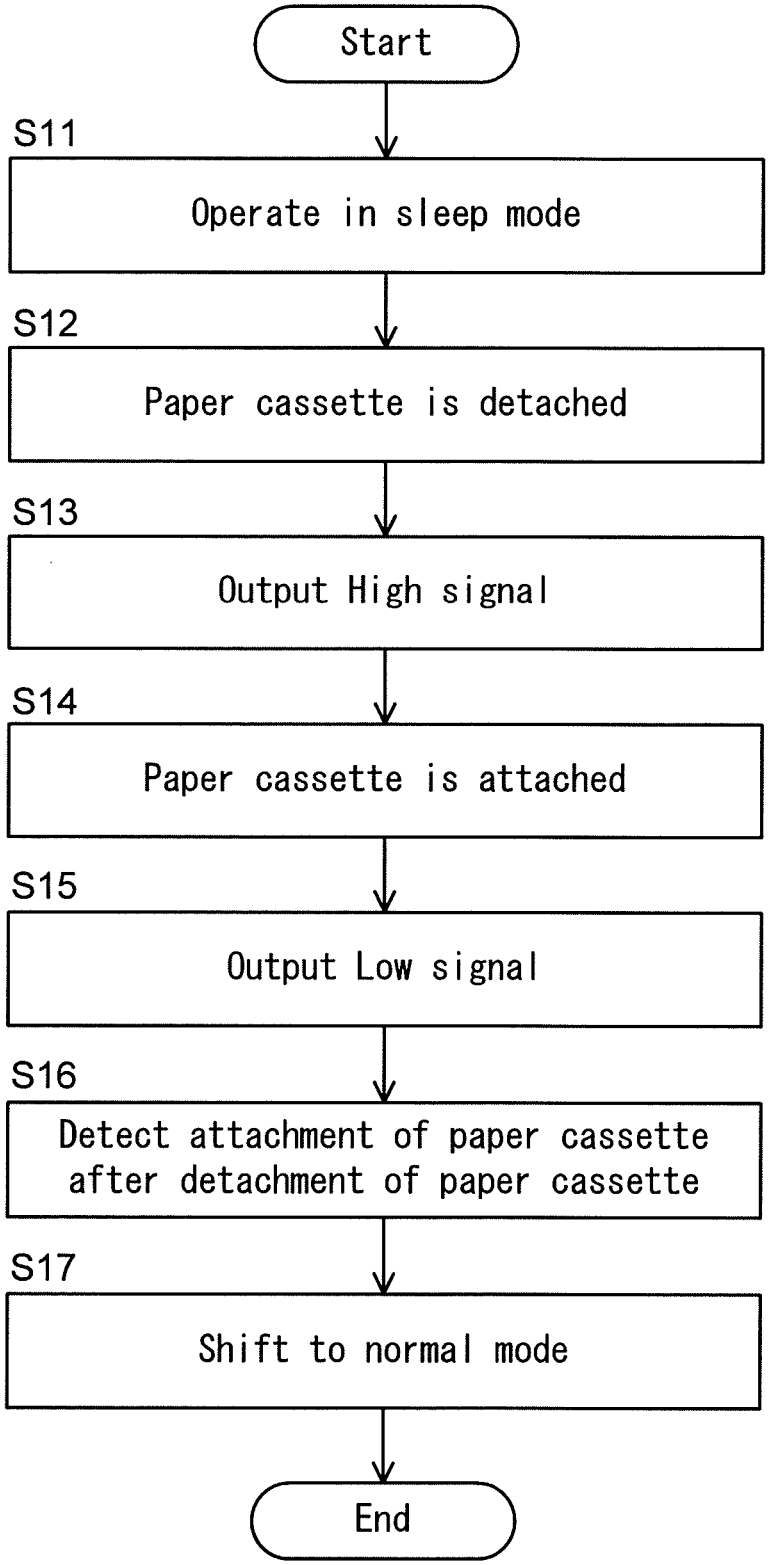
FIG. 3 is a flow chart showing operation of the control part performed upon paper storage into a paper cassette in a sleep mode.

Here, a case where paper is stored into the paper cassette 23*a* in the sleep mode will be described. FIG. 3 is a flow chart showing operation of the control part 11 performed upon the paper storage into the paper cassette 23*a* in the sleep mode. Referring to FIGS. 1 to 3, the description will be given.

First, the digital multifunction printer 10 operates in the sleep mode (Step S11 in FIG. 3. Hereinafter, the term "step" will be omitted). The paper cassette 23*a* is detached from the digital multifunction printer 10 (S12).

As a result, one terminal 27*a* and another terminal 27*b* are disconnected by the circuit component member 26*a*. The flip-flop circuit 25 outputs the High signal to the energy-saving control part 11*b* (S13). Then the paper is stored into the paper cassette 23*a* and the paper cassette 23*a* is attached to the digital multifunction printer 10 (S14).

As a result, the one terminal 27*a* and another terminal 27*b* are connected together by the circuit component member 26*a*, and the flip-flop circuit 25 outputs the Low signal to the energy-saving control part 11*b* (S15).

As a result, the energy-saving control part 11*b* detects that the signal outputted from the flip-flop circuit 25 has changed from High to Low. This leads to detection that the paper cassette 23*a* has been attached after detached (S16). Here, the energy-saving control part 11*b*, the circuit component member 26*a*, and the predetermined circuit 24 operate as a detection part.

As a result, since the operation is in the sleep mode, the energy-saving control part 11*b* performs control in a manner such that a current is supplied to the engine control part 11*a*. The digital multifunction printer 10 shifts from the sleep mode to the normal mode (S17). Here, the control part 11 operates as a shift part. Then the engine control part 11*a*, for example, holds in the hard disc 17 or the like information indicating that the paper has been stored into the paper cassette 23*a*, and performs, for example, calculation of the number of pieces of paper inside the paper cassette 23*a*.

In this manner, the digital multifunction printer 10, upon the detection that the paper cassette 23*a* has been attached during the operation in the sleep mode, shifts from the second mode to the first mode. Consequently, for example, even in a case where the paper cassette 23*a* is left in a continuously detached state for predetermined time, until detection that the paper cassette 23*a* has been attached, the second mode is maintained, thus not resulting in wasteful power consumption. This consequently makes it possible to efficiently save the power consumption.

Figure 4:
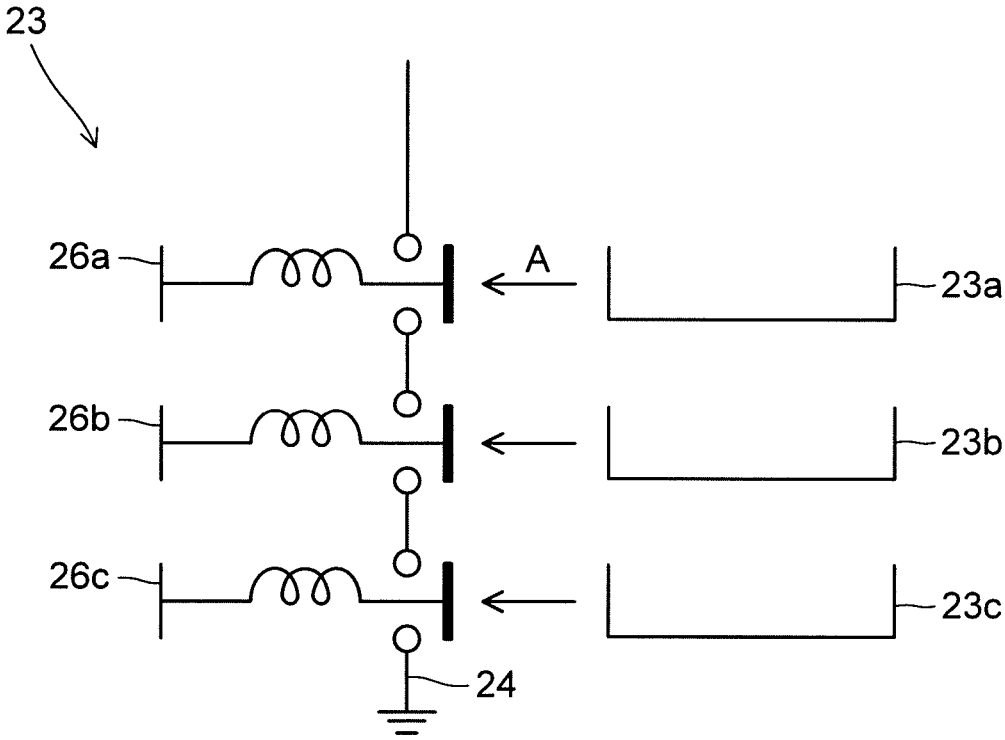
FIG. 4 is a diagram showing the paper feed part when a plurality of paper cassettes is provided.

The above embodiment has been described, referring to, as an example, a case where the paper feed part 23 is provided with one paper cassette, although not limited thereto, and thus a plurality of paper cassettes may be provided. FIG. 4 is a diagram showing the paper feed part 23 in a case where a plurality of paper cassettes is provided. Note that FIG. 4 is a diagram corresponding to the paper feed part 23 in FIG. 2. Referring to FIGS. 1 to 4, the case where the plurality of paper cassettes is provided will be described.

The plurality of paper cassettes 23*a* to 23*c* are set, for example, in multiple levels in a vertical direction of the digital multifunction printer 10. In this embodiment, the three levels including an upper level, a middle level, and a lower level are set. In correspondence with the plurality of paper cassettes 23*a* to 23*c*, a plurality of circuit component members 26*a* to 26*c* is respectively provided.

The plurality of circuit component members 26*a* to 26*c* is so provided as to form part of the same circuit 24 upon attachment of the plurality of paper cassettes 23*a* to 23*c* to the digital multifunction printer 10. Consequently, a paper cassette can easily be added without increasing wires. Moreover, in this case, when all the plurality of paper cassettes 23*a* to 23*c* has been attached to the digital multifunction printer 10, the flip-flop circuit 25 outputs toward the energy-saving control part 11*b* a Low signal indicating that the paper cassettes 23*a* to 23*c* have been attached. Moreover, when at least one of the plurality of paper cassettes has been detached from the digital multifunction printer 10, the predetermined circuit 24 is blocked. Therefore, when at least one of the plurality of paper cassettes has been detached from the digital multifunction printer 10, the flip-flop circuit 25 outputs toward the energy-saving control part 11*b* a High signal indicating that the paper cassette has been detached.

Consequently, the second mode is maintained until detection that all the plurality of paper cassettes 23*a* to 23*c* has been attached, thus not resulting in wasteful power consumption. This consequently makes it possible to efficiently save the power consumption.

Moreover, the above embodiment has been described, referring to, as an example, a case where the detachment and the attachment of the paper cassette 23*a* are detected by the energy-saving control part 11*b* during the operation in the sleep mode, but control may be performed in a manner such that the detection is performed at the engine control part 11*a* by use of, for example, a transistor, during the operation in the normal mode.

The embodiment of the invention has been described above, referring to the drawings, but the invention is not limited to the embodiment illustrated. Various modifications and variations can be made to the embodiment illustrated within the same scope of the invention or within an equivalent scope.

What is claimed is:

1. An image forming apparatus having a first mode for operation with predetermined power consumption and a second mode for operation with less power consumption than the power consumption in the first mode, the image forming apparatus comprising:

a plurality of paper cassettes capable of being attached to a predetermined section of the image forming apparatus, each paper cassette storing paper therein;

a detection part detecting the attachment and detachment of the paper cassettes to and from the predetermined section; and a shift part which, when the image forming apparatus is in the second mode, does not shift the image forming apparatus from the second mode to the first mode when the detection part detects that one of the paper cassettes attached to the predetermined section is being detached, the shift part maintaining the second mode until detection by the detection part that all the plurality of paper cassettes have been attached to the predetermined section, whereby the shift part shifts the image forming apparatus from the second mode to the first mode when the detection part detects that all of the paper cassettes are attached to the predetermined section.

2. The image forming apparatus according to claim 1, wherein:

each paper cassette is movable by being attached to and detached from the predetermined section;

the detection part has: a predetermined circuit turned ON/OFF for current flow control, and a circuit component member movable in conjunction with the paper cassettes;

the circuit component member moves to a position forming part of the predetermined circuit upon the attachment of a paper cassette to the predetermined section, and moves to a position away from the predetermined circuit upon the detachment of the paper attached cassette from the predetermined section; and the detection part, as a result of the turning ON of the current flowing through the predetermined circuit, detects the attached paper cassette.

3. The image forming apparatus according to claim 2, wherein:

a plurality of circuit component members is respectively provided in correspondence with the plurality of paper cassettes.

4. The image forming apparatus according to claim 3, wherein the plurality of circuit component members forms part of the same predetermined circuit upon the attachment of all the paper cassettes to the predetermined section.

5. The image forming apparatus according to claim 4, wherein through the predetermined circuit, the current flows as a result of attaching all the plurality of paper cassettes to the predetermined section, and the flowing current is shut off upon detachment of at least one of the plurality of paper cassettes from the predetermined section.

* * * * *